US010167695B2

(12) United States Patent
Kroesen

(10) Patent No.: US 10,167,695 B2
(45) Date of Patent: Jan. 1, 2019

(54) BLOWOUT PREVENTER INCLUDING SHEAR BODY

(71) Applicant: Cameron International Corporation, Houston, TX (US)

(72) Inventor: Gerrit M. Kroesen, Friendswood, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/936,291

(22) Filed: Nov. 9, 2015

(65) Prior Publication Data

US 2017/0130549 A1 May 11, 2017

(51) Int. Cl.

| | |
|---|---|
| ***E21B 33/06*** | (2006.01) |
| ***E21B 29/08*** | (2006.01) |
| ***E21B 33/08*** | (2006.01) |
| ***E21B 33/064*** | (2006.01) |

(52) U.S. Cl.

CPC ..... *E21B 33/063* (2013.01); *E21B 29/08* (2013.01); *E21B 33/061* (2013.01); *E21B 33/064* (2013.01); *E21B 33/085* (2013.01); *Y10T 137/8803* (2015.04); *Y10T 137/88038* (2015.04)

(58) Field of Classification Search

CPC ..... E21B 33/06; E21B 33/064; E21B 33/085; Y10T 137/8803; Y10T 137/88038

USPC ..... 137/614.17, 614.18; 251/1.1, 208, 345

See application file for complete search history.

(56) References Cited

U.S. PATENT DOCUMENTS

| | | | | |
|---|---|---|---|---|
| 2,504,377 | A * | 4/1950 | Beil | E21B 33/061 251/1.1 |
| 3,766,978 | A * | 10/1973 | Orund | E21B 29/08 166/361 |
| 4,160,478 | A * | 7/1979 | Calhoun | E21B 29/04 166/319 |
| 4,923,005 | A * | 5/1990 | Laky | E21B 19/22 166/335 |
| 5,931,442 | A * | 8/1999 | Cummins | B63C 11/52 166/298 |
| 6,152,229 | A * | 11/2000 | Jennings | E21B 29/04 137/613 |
| 6,244,336 | B1 | 6/2001 | Kachich | |
| 7,510,002 | B2 * | 3/2009 | Brown | E21B 33/061 166/330 |
| 8,353,497 | B2 * | 1/2013 | Trevas | E21B 33/06 166/387 |
| 8,567,490 | B2 | 10/2013 | van Winkle | |
| 8,839,817 | B2 * | 9/2014 | Dederich | F16K 31/54 137/614.11 |
| 9,410,391 | B2 * | 8/2016 | Guven | E21B 29/04 |

(Continued)

FOREIGN PATENT DOCUMENTS

| | | |
|---|---|---|
| EP | 2400110 | 7/2013 |

OTHER PUBLICATIONS

International Search Report and Written Opinion of PCT Application No. PCT/US2016/059490 dated Feb. 1, 2017: pp. 1-14.

(Continued)

*Primary Examiner* — Matthew W Jellett
(74) *Attorney, Agent, or Firm* — Helene Raybaud

(57) ABSTRACT

A blowout preventer ("BOP") includes a housing comprising a vertical bore extending through the housing and a shear body rotatable with respect to the vertical bore to shear an object located within the vertical bore.

18 Claims, 11 Drawing Sheets

(56) References Cited

U.S. PATENT DOCUMENTS

| | | | | |
|---|---|---|---|---|
| 9,422,785 | B2 * | 8/2016 | Kukielka | E21B 21/106 |
| 2006/0102359 | A1 | 5/2006 | Brown et al. | |
| 2014/0116717 | A1 * | 5/2014 | Guven | E21B 29/04 166/361 |
| 2016/0102519 | A1 * | 4/2016 | Molaschi | E21B 29/02 166/363 |

OTHER PUBLICATIONS

International Preliminary Report on Patentability for the equivalent International patent application PCT/US2016/059490 dated May 24, 2018.

* cited by examiner

BLOWOUT PREVENTER INCLUDING SHEAR BODY

BACKGROUND

This section is intended to provide background information to facilitate a better understanding of the various aspects of the described embodiments. Accordingly, it should be understood that these statements are to be read in this light and not as admissions of prior art.

Blowout preventers ("BOPs") are used extensively throughout the oil and gas industry. Typical BOPs are used as a large specialized valve or similar mechanical device that seals, controls, and monitors oil and gas wells. The two most common types of BOPs are ram BOPs and annular BOPs, and these BOPs are often arranged in a BOP stack with at least one annular BOP stacked above several ram BOPs. The ram units in ram BOPs allow for shearing drill pipe with shear rams, sealing off around drill pipe with pipe rams, and sealing the BOP bore with blind rams. Typically, a BOP stack may be secured to a wellhead to provide a safe means for sealing the well in the event of a system malfunction.

An example ram BOP includes a main body or housing with a vertical bore. Ram bonnet assemblies may be bolted to opposing sides of the main body using a number of high tensile fasteners, such as bolts or studs. These fasteners hold the bonnet in position to enable the sealing arrangements to work effectively. An elastomeric sealing element may be used between the ram bonnet and the main body. There are several configurations, but essentially are all directed to preventing a leakage bypass between the mating faces of the ram bonnet and the main body.

Each bonnet assembly includes a piston that moves laterally within a ram cavity of the bonnet assembly by pressurized hydraulic fluid acting on the piston. The opposite side of each piston has a connecting rod attached thereto that in turn has a ram or ram assembly mounted thereon for extension into the vertical bore. The rams can be shear rams for shearing an object within the bore of a BOP or blind rams for sealing the BOP bore. Alternatively, the rams can be pipe rams for sealing off around an object within the bore of a BOP, such as a pipe, thereby sealing the annular space between the object and the BOP bore.

During normal operation, the BOPs may be subject to pressures up to 10,000 psi, or even higher. To accommodate such pressures, BOPs are becoming larger and stronger. For example, it is becoming increasingly common for BOP stacks and related devices to reach heights of about 30 feet or more and to be constructed from stronger or harder materials. However, these BOPs, even with all this supporting equipment, may still have difficulties cutting and shearing some tubular members though commonly used within the industry, and need to be constructed of a material that is NACE International compliant.

DESCRIPTION OF THE DRAWINGS

For a detailed description of the embodiments of the invention, reference will now be made to the accompanying drawings in which.

DETAILED DESCRIPTION

BOPs may be included at a wellhead when drilling or completing a well to close off the well to prevent a blowout. Such a blowout might occur, for example, when the well intersects a pocket of fluid under high pressure, which then progresses through the well bore. A BOP closes to seal the well against the fluid pressure from below. A BOP can also be used to seal off the well around a pipe in the wellbore during drilling operations involving positive downhole pressure. In practice, multiple BOPs may be arrayed in a vertical stack (i.e., a BOP stack), which is positioned over the well, with the well piping or tubing extending up through the center of the BOP stack. BOPs can be used in conjunction with onshore and offshore drilling and completion operations.

Figure 1A:
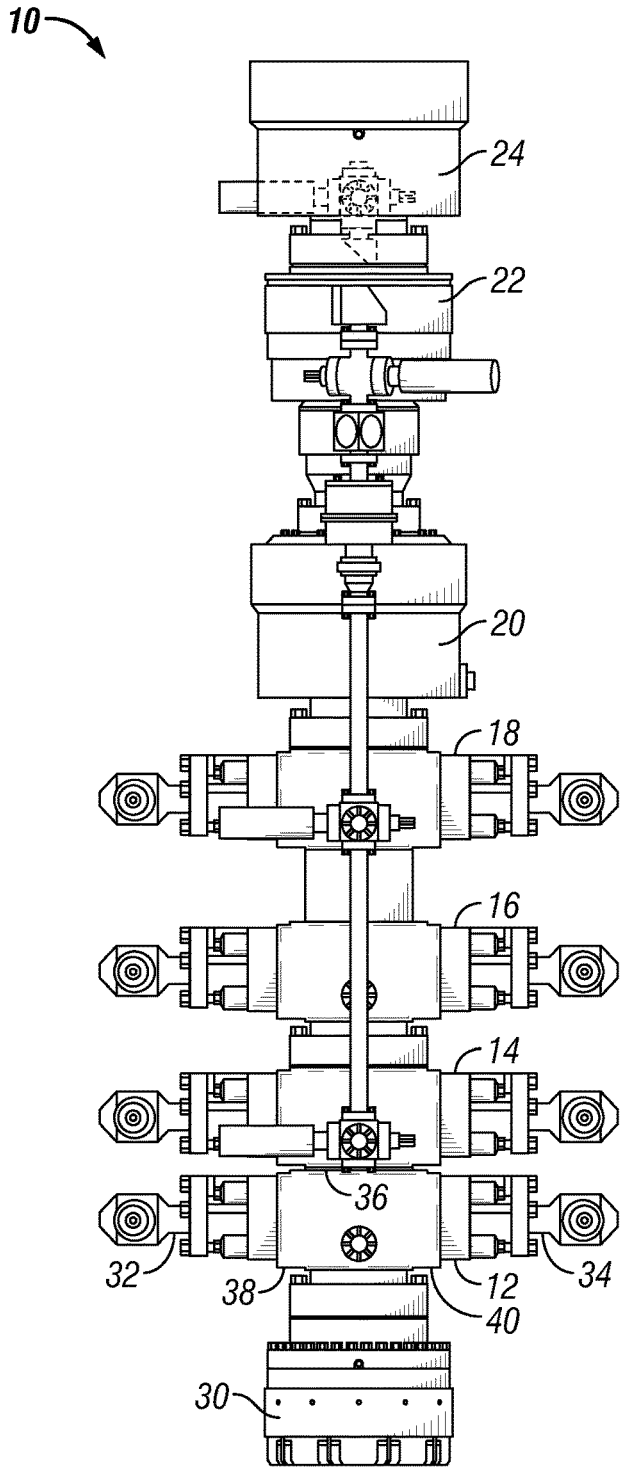
FIGS. 1A and 1B depict side elevation views of an example BOP stack, according to one or more embodiments.
Figure 1B:
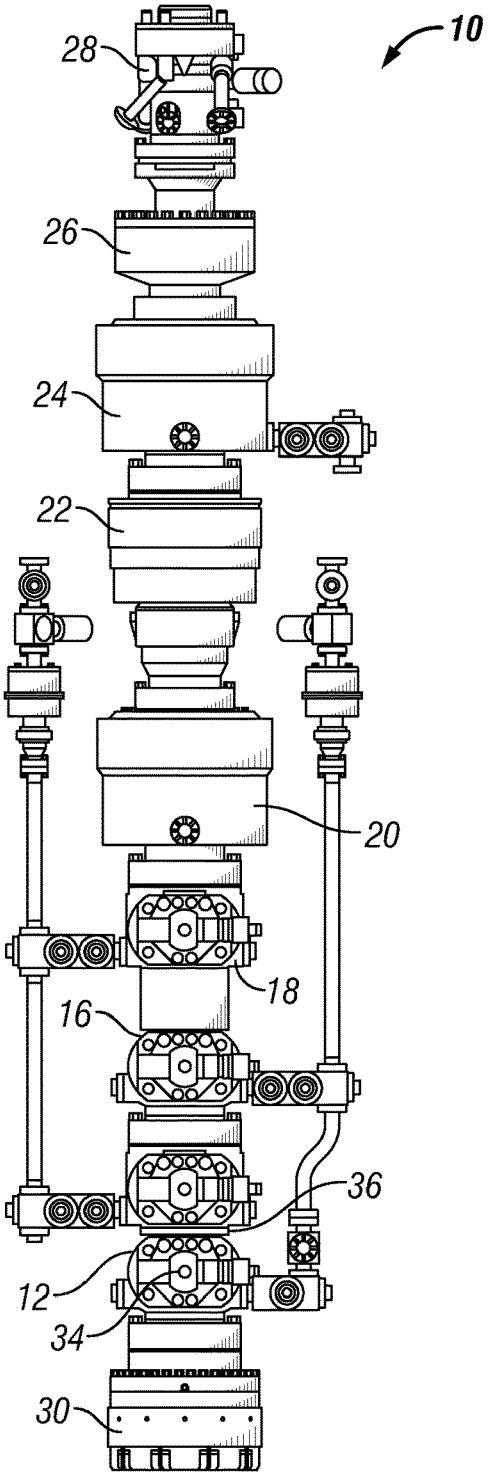

FIGS. 1A and 1B provide two views of a BOP stack shown generally at 10. The BOP stack 10 may be used for onshore or offshore environments, and for both surface and subsea applications. Various hydraulic lines, framework, and control apparatus for operating the BOP stack 10 are not shown for purposes of clarity. The stack 10 in this embodiment includes four ram-type BOPs 12, 14, 16, and 18. The ram-type BOPs 12, 14, 16, and 18 can include pipe rams, blind rams, shear rams, etc. An annular BOP 20, a connector 22, a second annular BOP 24, and a flex joint 26 are arrayed above the ram-type BOPs 12, 14, 16, and 18. A riser adapter 28 is positioned at the top of the stack 10 for connection to a marine riser above (not shown). A wellhead connector 30 is located at the bottom of the stack 10 for connection to a wellhead below (not shown). In general, the number and kind of BOPs in a stack, as well as the order in which they are arrayed in the stack, may vary.

A ram-type BOP includes a pair of linear drive devices, or linear actuators, located on opposite sides of a central BOP housing. The linear actuators provide lateral movement along a straight line, perpendicular to the vertical, toward and away from the housing. For example, the ram-type BOP 12 provides a pair of piston and cylinder assemblies 32 and 34 with the cylinders fixed on opposite sides of a central housing 36 positioned over the well so that the pistons are movable along a line perpendicular to the vertical, that is, perpendicular to the well bore at the surface of the well. The piston and cylinder assemblies 32 and 34 are housed in cavities of bonnet assemblies disposed on either side of the BOP housing.

As shown, the bottom two BOPs 12 and 14 have a common, extended central housing 36. A central vertical bore through the housing 36 is aligned with the well bore so that well pipe extending from the well passes upwardly through the housing along its central bore. The pistons are hydraulically operated to simultaneously move toward each other, or away from each other. Each piston carries a ram at the piston end toward the well, so that the two rams meet in a closed position at the housing central bore when the pistons are driven together, and are pulled apart by the pistons to an open configuration. The central vertical bores through housings of the ram-type BOPs 12, 14, 16, and 18 form part of a central vertical passageway extending from the wellhead and the well bore below, up through all of the elements in the BOP stack 10 and on through the marine riser.

A cavity is provided within the central housing for each ram-type BOP 12, 14, 16, and 18, that is, for each pair of piston and cylinder combinations 32/34. Each cavity intersects the vertical bore of the housing 36 and extends radially outwardly toward the piston and cylinder structures 32 and 34 in two guideways 38 and 40, with each guideway interposed between the central housing and a corresponding piston and cylinder assembly. The ram carried by a piston resides and moves within the corresponding guideway and cavity.

The rams in a multiple BOP stack may operate in different ways in closing off the well. Pipe rams seal around a tubular pipe extending from the well, closing off the annulus between the well pipe and the well bore surface. Blind rams seal across the well with no pipe at the location of the blind ram. Shear, or cutting, rams shear the well pipe, but do not seal off the annulus around the pipe. Blind shear rams shear the well pipe and close and seal the well. A BOP with blind shear rams is typically at the top of a ram-type BOP stack, with various pipe rams in BOPs located below. In a typical application, the top ram-type BOP 18 would be fitted with blind shear rams, and the lower BOPs 12, 14, 16, and 18 would contain pipe rams.

Figure 2:
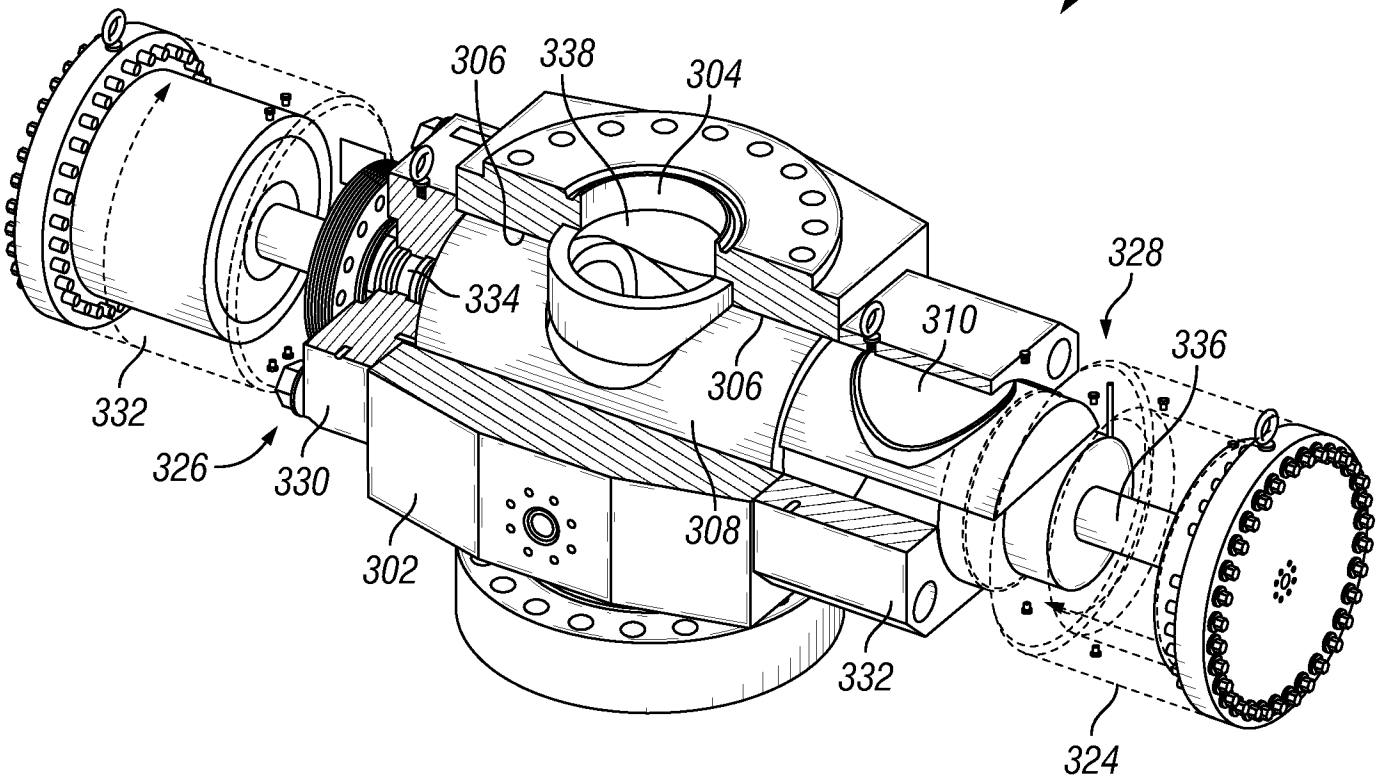
FIG. 2 depicts a sectional perspective view of an example BOP in an open position, according to one or more embodiments.
Figure 3:
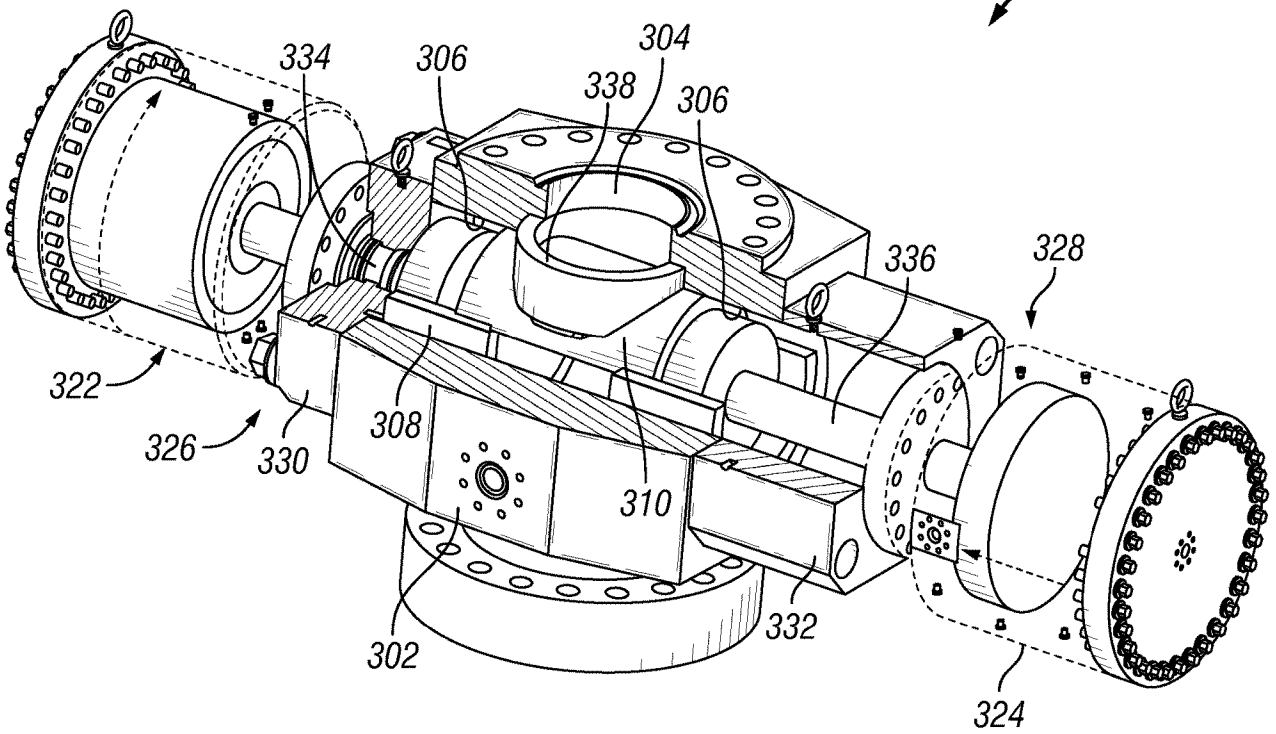
FIG. 3 depicts a sectional perspective view of an example BOP in a closed position, according to one or more embodiments.

Turning now to FIGS. 2 and 3, sectional perspective views of a BOP 300 in accordance with one or more embodiments of the present disclosure are shown for illustrative purposes. The BOP 300 includes a housing or body 302 with a bore 304 extending through the housing 302. The housing 302 also includes cavities 306 that intersect the bore 304 and are formed and positioned opposite each other with respect to the bore 304. The BOP 300 may be used for shearing (e.g., shearing an object located within the BOP 300) or for sealing (e.g., sealing across or about the bore 304 of the BOP 300). The BOP 300, thus, may include a shear body or shear spool 308 and/or a seal body or seal spool 310. FIG. 2 shows the shear body 308 and the seal body 310 in open positions (e.g., non-shearing and non-sealing positions), and FIG. 3 shows the shear body 308 and the seal body 310 in closed positions (e.g., shearing and sealing positions). In one or more embodiments, the shear body 308 may have at least a partially cylindrical shape such that the shear body 308 has an axis defined therethrough (with the shear body 308 rotatable about the axis). Similarly, the seal body 310 may have at least a partially cylindrical shape such that the seal body 310 has an axis defined therethrough (with the shear body 308 rotatable about the axis).

Figure 4:
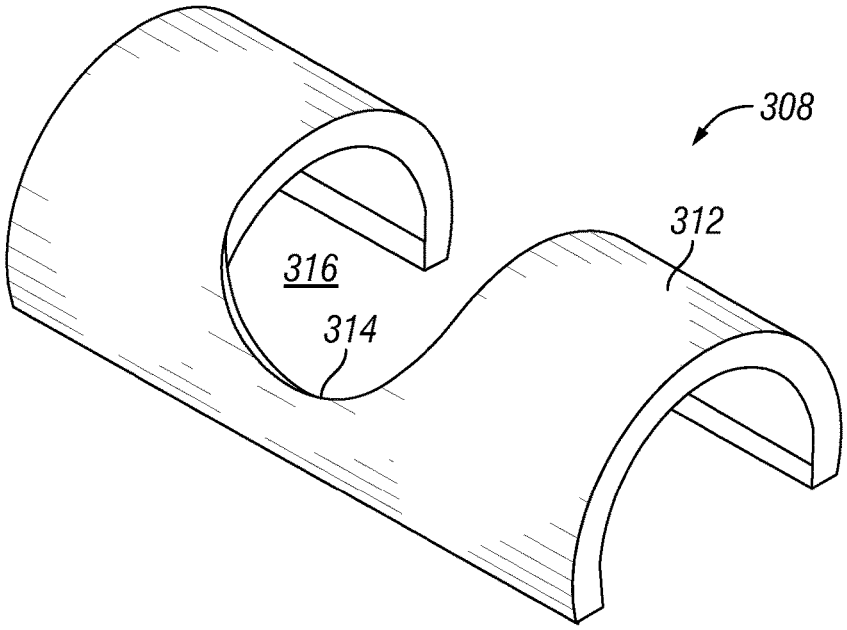
FIG. 4 depicts an upper perspective view of an example shear body, according to one or more embodiments.
Figure 5:
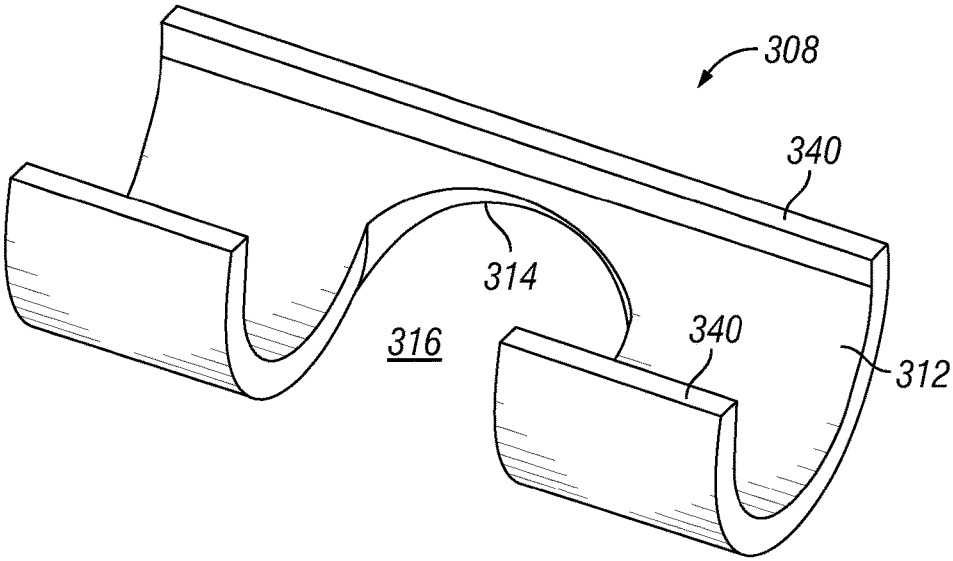
FIG. 5 depicts a lower perspective view of the shear body of FIG. 4, according to one or more embodiments.

FIGS. 4 and 5 provide upper and lower perspective views of the shear body 308 in accordance with one or more embodiments of the present disclosure for illustrative purposes. The shear body 308 includes a body 312 that has a generally semi-cylindrical shape (e.g., cylinder divided lengthwise). The shear body 308 also includes a shear blade 314 for shearing objects, with the shear blade 314 defining an opening or cutout 316 formed within the body 312 of the shear body 308. In this embodiment, the shear blade 314 may have an elliptical or circular shape (e.g., concave shape). The opening 316 may extend from the sides or ends of the shear blade 314 and across a majority of the body 312, such as by extending over about 90 degrees across the circumference of the body 312 (e.g., extend about 160 degrees of the 180-degree body). The opening 316 may then extend to an edge of the body 312 in this embodiment.

Figure 6:
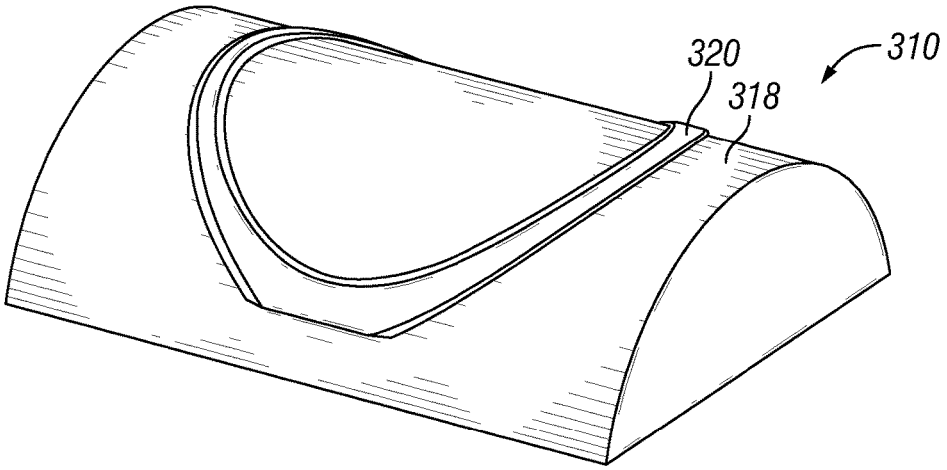
FIG. 6 depicts an upper perspective view of an example seal body, according to one or more embodiments.
Figure 7:
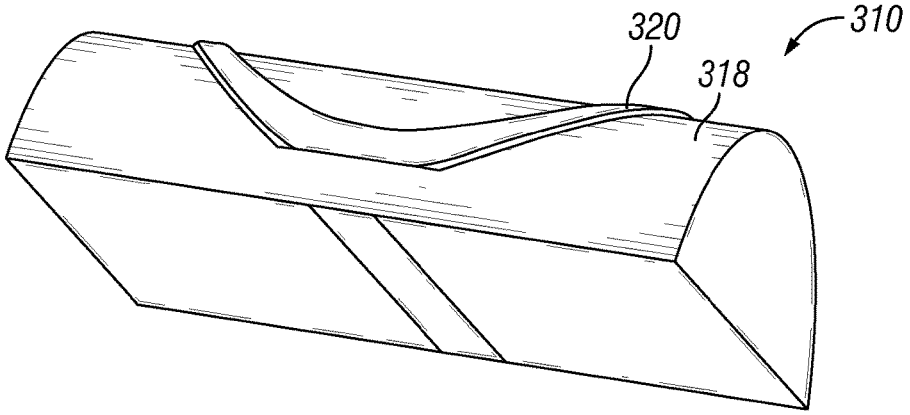
FIG. 7 depicts a lower perspective view of the seal body of FIG. 6, according to one or more embodiments.

FIGS. 6 and 7 provide upper and lower perspective views of the seal body 310 in accordance with one or more embodiments of the present disclosure for illustrative purposes. The seal body 310 includes a body 318 that has a generally semi-cylindrical outer surface on an upper side and a flat surface on a lower side. The seal body 310 also includes a seal 320. The seal 320 is shown as included on the upper side (e.g., cylindrical surface) of the seal body 310, such as by having the seal 320 positioned within a recess formed within the body 318 of the seal body 310. The seal body 310 may be used for sealing across or about the bore 304 of the BOP 300.

Referring now back to FIGS. 2 and 3, the shear body 308 is positioned within the BOP housing 302 such that the shear body 308 is rotatable within the bore 304 such that movement of the blade 314 can be used to shear an object located within the bore 304. As shown, the shear body 308 has each end positioned within a cavity 306 with the shear body 308 then intersecting the bore 304. The shear body 308 is rotatable about an axis of one or both of the cavities 306. Further, the shear body 308 is positioned within the BOP housing 302 such that opening 316 of the shear body 308 is aligned with the bore 304 to enable or permit objects to pass through the bore 304 of the BOP housing 302. Accordingly, the shear body 308 may be rotated about an axis of the cavities 306 from an open position to a closed position to have the shear blade 314 of the shear body 308 move across the BOP bore 304, thereby shearing an object located within the BOP bore 304 with the shear blade 314 of the shear body 308. In this embodiment, the shear body 308 rotates about 180 degrees from the open position to the closed position. FIG. 2 shows the shear body 308 in the open position and the seal body 310 in the open position (e.g., non-sealing position), FIG. 3 shows the shear body 308 in the closed position and the seal body 310 in the closed position (e.g., sealing position), and FIG. 4 shows the orientation of the shear body 308 when in the open position.

The seal body 310 is movable within or from the cavity 306 into the BOP bore 304 to form a seal about the BOP bore 304 within the BOP housing 302. In FIG. 2, the seal body 310 is shown as positioned within the bonnet assembly housing 332 (e.g., the open position) and in FIG. 3, the seal body 310 is shown as having been moved to intersect the BOP bore 304 (e.g., the closed position), thereby forming a seal against or within the BOP housing 302 to prevent fluid or debris from passing through the BOP bore 304. The seal body 310 is receivable within the BOP bore 304 when the shear body 308 is in the closed position. Otherwise, when in the open position, the shear body 308 occupies the same space within the BOP bore 304 that the seal body 310 does, and therefore the shear body 308 is rotated to the closed position to receive the seal body 310 within the BOP bore 304. The seal body 310 is then positioned within the BOP housing 302 such that the seal 320 is positioned about the BOP bore 304.

The shear body 308 and the seal body 310 are movably positioned within the BOP housing 302. Accordingly, in one or more embodiments, one or more actuators may be included with the BOP 300 to move the shear body 308 and/or the seal body 310 within the BOP housing 302. For example, in FIGS. 2 and 3, a shear body actuator 322 is operably coupled to the shear body 308 to move the shear body 308 within the BOP housing 302, such as to have the shear body actuator 322 rotate the shear body 308 within the BOP bore 304 of the housing 302. Further, a seal body actuator 324 is operably coupled to the seal body 310 to move the seal body 310 within the BOP housing 302, such as to have the seal body actuator 324 laterally move the seal body 310 into and out of the BOP bore 304 of the housing 302. The actuators 322 and 324 may be any type of actuator known in the art, such as a hydraulic, pneumatic, electric, mechanical, and/or any other type of actuator known in the art. For example, in this embodiment, the shear body actuator 322 may be an electric actuator, and the seal body actuator 324 may be a hydraulic actuator.

The shear body actuator 322 may be operably coupled to the shear body 308 through a shear body bonnet assembly 326, and the seal body actuator 324 may be operably coupled to the seal body 310 through a seal body bonnet assembly 328. Each bonnet assembly 326 and 328 may include a bonnet assembly housing 330 and 332, respectively, secured or coupled to the BOP housing 302. A rod 334 then extends from the shear body actuator 322, into the shear body bonnet assembly housing 330, and to the shear body 308 to operably couple the shear body actuator 322 to the shear body 308. This enables the shear body actuator 322 to be able to impart rotation to the shear body 308. Further, a rod 336 extends from the seal body actuator 324, into the seal body bonnet assembly housing 332, and to the seal body 310 to operably couple the seal body actuator 324 to the seal body 310. This enables the seal body actuator 324 to be able to impart linear movement to the seal body 310. Rotation of the shear body 308 may also be effected by a helical groove and pin structure that translate linear movement of the actuator into rotational movement of the pin and coupled shear body.

In one or more embodiments, the BOP 300 may include or have positioned within the BOP housing 302 an insert 338 (shown in phantom within the figures). As shown in FIGS. 2 and 3, the insert 338 may have a cylindrical shape such that a bore extends through the insert 338. The insert 338 may then be positioned about the BOP bore 304 between the shear body 308 and the BOP housing 302 such that the bore of the insert 338 is collinear or coaxial with the BOP bore 304. Further, in this embodiment, the insert 338 is positioned within a recess formed within the BOP housing 302. When shearing an object within the BOP 300, the shear body 308 may shear the object by forcing and shearing the object against the insert 338. This may prevent damage to the BOP housing 302, and the insert 338 may be replaced when damaged. Further, the shear body 308 and/or the insert 338 may include or be formed from a hardened material (e.g., a material harder than that of the BOP housing 302), such as by heat-treating the shear body 308 and/or the insert 338. Further, the shear body 308 and/or the insert 338 may include or be formed from a material that meets NACE International compliance standards, such as NACE corrosion and sulfide stress cracking standards from NACE MR0175/ISO 15156.

Further, in one or more embodiments, the BOP 300 may include a feature to facilitate or urge the seal body 310 into sealing engagement within the BOP housing 302. For example, as best shown in FIG. 5, the shear body 308 may include a tapered edge or surface 340. When the seal body 310 is received within the BOP bore 304 (i.e., the shear body 308 is in the closed position), the bottom surface of the seal body 310 may engage the tapered edge 340 of the shear body 308. This engagement between the seal body 310 and the tapered edge 340 of the shear body 308 may urge the seal body 310 axially and into sealing engagement with the BOP housing 302. In particular, the tapered edge 340 may urge the seal 320 of the seal body 308 into sealing engagement with the insert 338 of the BOP housing 302, thereby enabling the seal body 310 to seal across or about the bore 304 of the BOP 300.

Figure 8:
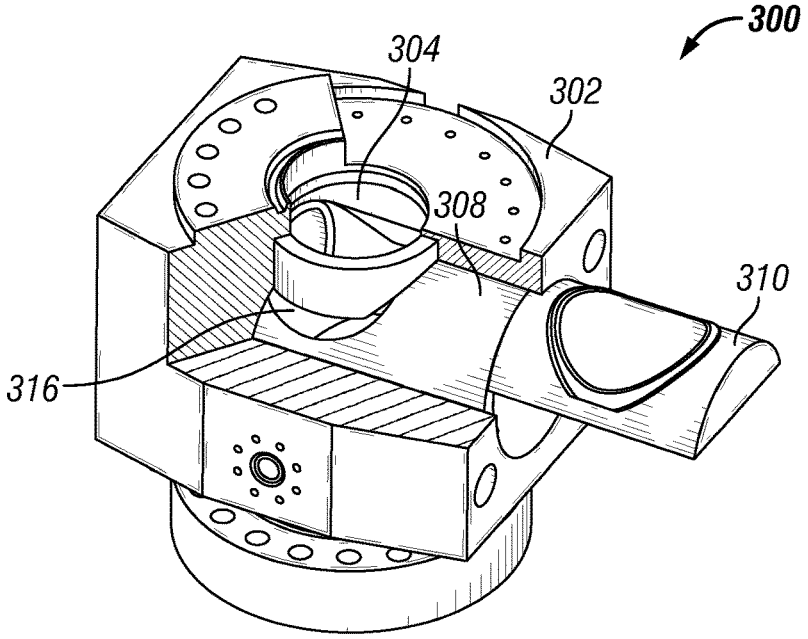
FIGS. 8-13 depict multiple sectional views of an example BOP when used for shearing or sealing, according to one or more embodiments.
Figure 9:
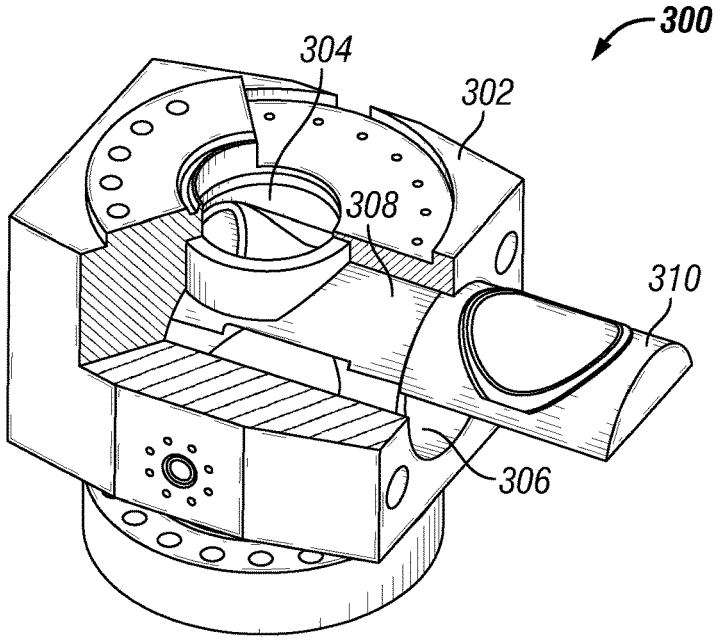
Figure 10:
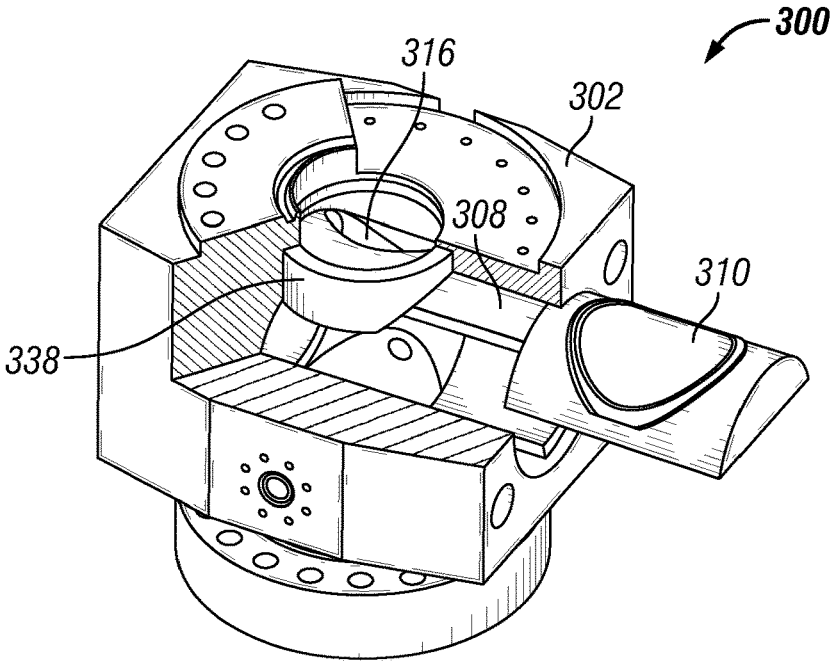

Referring now to FIGS. 8-13, multiple sectional views of a BOP 300 when used for shearing or sealing in accordance with one or more embodiments of the present disclosure are shown for illustrative purposes. The BOP 300 in FIGS. 8-13 may be similar to the BOP 300 shown in FIGS. 2 and 3, but for simplicity, the actuators and bonnet assemblies have been removed. In FIG. 8, the shear body 308 positioned within the BOP bore 304 is in the open position such that the opening 316 of the shear body 308 is aligned with the BOP bore 304 to allow for an object to be positioned within the BOP bore 304. In FIG. 9, the shear body 308 begins to rotate (as indicated by the arrow), such as through a shear body actuator, within the BOP bore 304 with the shear body 308 rotating about an axis of the cavity 306 of the BOP housing 302. In FIG. 10, the shear body 308 continues to rotate within the BOP bore 304, and between FIGS. 10 and 11, the opening 316 of the shear body 308 has moved fully across the BOP bore 304 such that no gap exists between the shear body 308 and the BOP housing 302 in FIG. 11. Accordingly, though not shown, the shear body 308 may shear the object by forcing and shearing the object against the insert 338 of the BOP housing 302. An object can include a tubular member, a tool joint, a drill collar, a drilling tubular, and/or any other object used within drilling or production environment. Further, the shear body 308 may be used to clear away debris within the BOP bore 304 when moving from the open position to the closed position, whether or not an object is present for shearing within the BOP bore 304.

Figure 11:
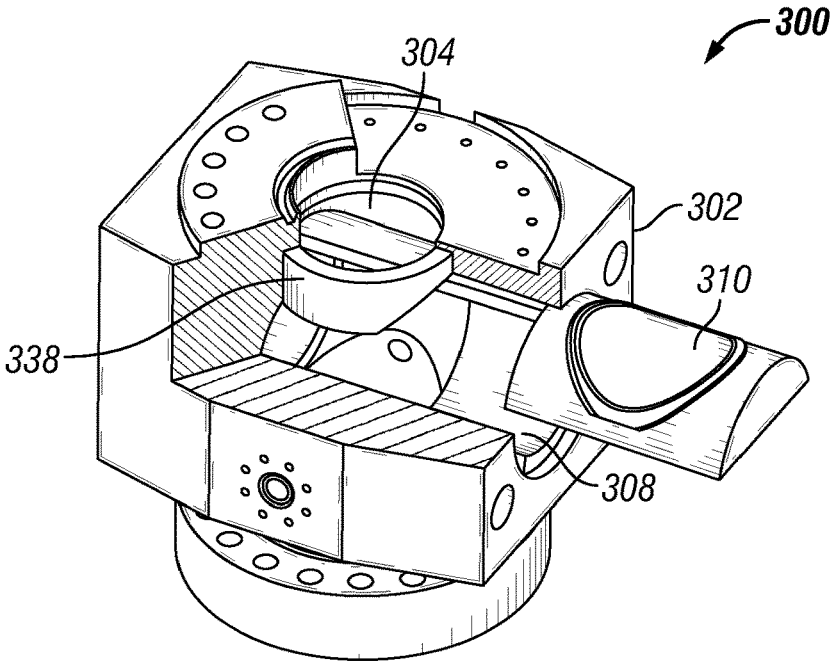
Figure 12:
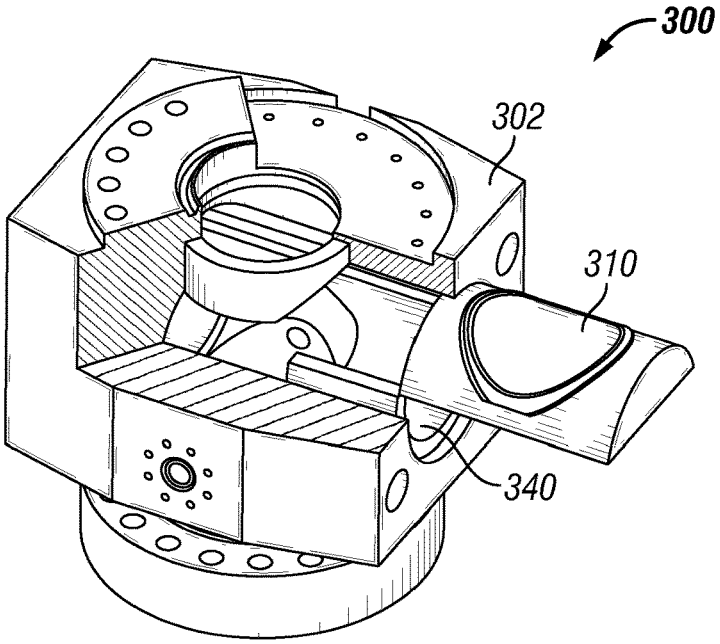
Figure 13:
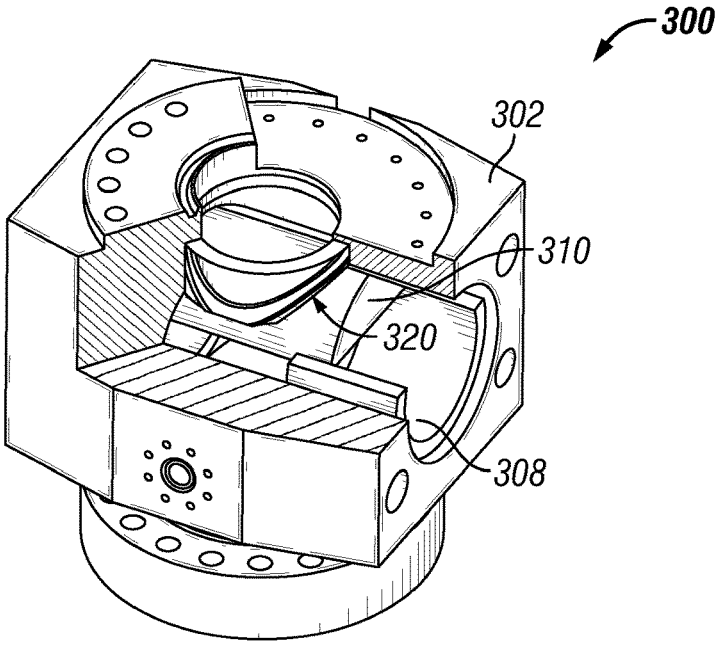

Continuing with FIG. 11 and to FIG. 12, the shear body 308 continues to rotate within the BOP bore 304 until the shear body 308 reaches the closed position. The shear body 308 is shown in the closed position in FIG. 12. Once in the closed position, the BOP 300 is then ready to receive the seal body 310 within the BOP bore 304. Accordingly, in FIG. 12, the seal body 310 is moved laterally, such as by the shear body actuator, along the cavity 306 of the BOP housing 302 to intersect with the BOP bore 304. As the seal body 310 moves to intersect with the BOP bore 304, the seal body 310 engages the tapered edge 340 of the shear body 308, thereby urging the seal body 310 axially and into sealing engagement with the BOP housing 302. As shown in FIG. 13, the seal 320 of the seal body 308 is in sealing engagement with the insert 338 of the BOP housing 302, thereby enabling the seal body 310 to seal across or about the bore 304 of the BOP 300.

Figure 15:
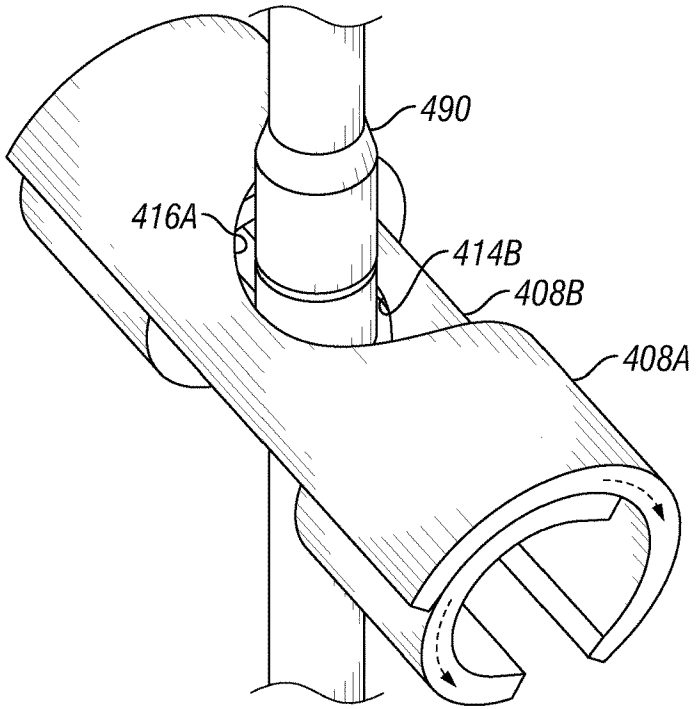
FIGS. 14-16 depict multiple sectional views of an example BOP when used for shearing, according to one or more embodiments.
Figure 14:
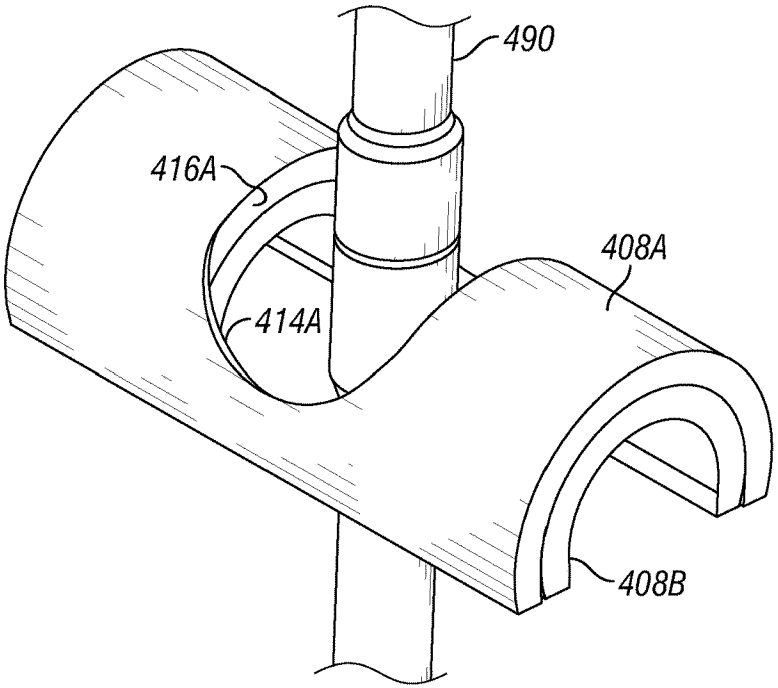
Figure 16:
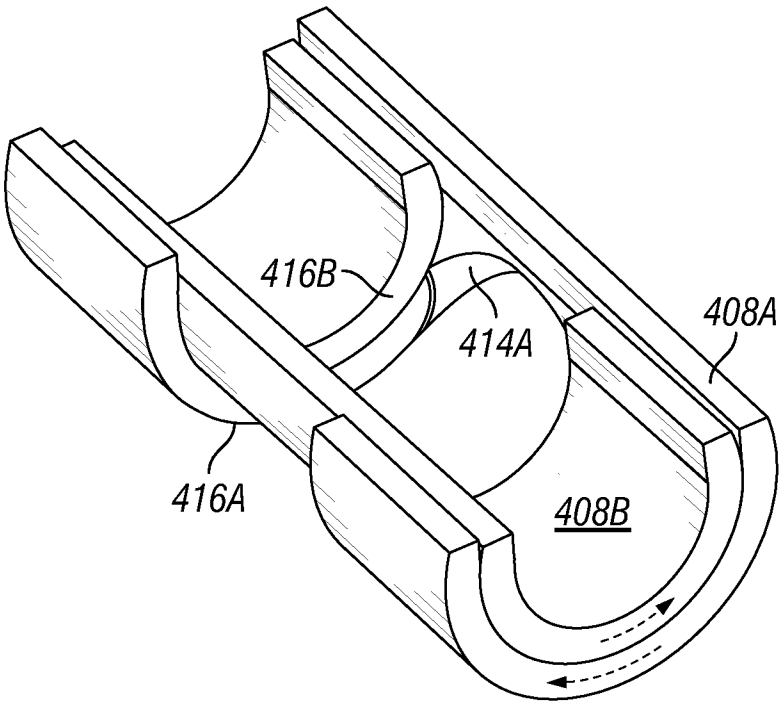

Referring now to FIGS. 14-16, multiple perspective views of an embodiment including more than one shear body 408 for use with a BOP in accordance with one or more embodiments of the present disclosure are shown for illustrative purposes. In this embodiment, two shear bodies 408A and 408B are shown, in which the shear bodies 408A and 408B may be used to shear an object 490 positioned within the BOP bore. The shear body 408A is shown as similar to the shear body 308 in the above embodiments, such as by including a shear blade 414A that defines an opening or cutout 416A formed within the shear body 408A. The shear body 408B may then be similar to the shear body 408B by also including a shear blade 414B that defines an opening or cutout 416B formed within the shear body 408B.

The second shear body 408B may be smaller than the first shear body 408A in this embodiment (e.g., smaller radius) such that the second shear body 408B may be positioned within the first shear body 408A. Further, the first shear body 408A and the second shear body 408B may each be separately rotatable, rotatable about the same axis, and/or rotatable in different directions with respect to each other. For example, as shown from FIGS. 14-16, the first shear body 408A may rotate in a first direction (e.g., clockwise direction), and the second shear body 408B may rotate in a second direction (e.g., counter-clockwise direction), as indicated by the arrows. Each of the shear blades 414A and 414B may be used to shear the object 490 as the shear bodies 408A and 408B move from the open position (in FIG. 14) to the closed position (in FIG. 16). Once in the closed position, a seal body may then be moved above the shear bodies 408A and 408B to form a seal across the BOP bore. In one or more embodiments, the same actuator may be used to rotate the first shear body and the second shear body. However, in another embodiment, a separate actuator may be used to rotate the first shear body independently of the second shear body.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A blowout preventer ("BOP"), comprising:

a housing comprising:

a vertical bore extending through the housing and defined about a vertical bore axis; and a cavity intersecting the vertical bore and defined about a cavity axis, wherein the cavity is cylindrical about the cavity axis, and the cavity axis is perpendicular to the vertical bore axis;

a shear body comprising a semi-cylindrical shape and rotatable about the cavity axis of the housing to shear an object located within the vertical bore; and a seal body configured to move along the cavity axis within the cavity and into the vertical bore to form a seal about the vertical bore within the housing, wherein the seal body is configured to move relative to the shear body and into the vertical bore to form the seal while the shear body is positioned at least partially within the vertical bore.

2. The BOP of claim 1, further comprising a shear body actuator operably coupled to the shear body to rotate the shear body within the vertical bore of the housing.

3. The BOP of claim 1, further comprising a seal body actuator operably coupled to the seal body to move the seal body into the vertical bore of the housing.

4. The BOP of claim 1, wherein the shear body is rotatable from a first position to a second position within the vertical bore to shear the object located within the vertical bore, and in the first position the shear body blocks the seal body from moving into the vertical bore to form the seal, and in the second position the shear body enables the seal body to move into the vertical bore to form the seal.

5. The BOP of claim 4, wherein the shear body is rotatable by about 180 degrees from the first position to the second position.

6. The BOP of claim 4, wherein the shear body engages the seal body within the vertical bore when the shear body is in the second position and when the seal body forms the seal.

7. The BOP of claim 1, wherein the shear body comprises a tapered edge to urge the seal body into sealing engagement with the housing when the seal body is received within the vertical bore of the housing.

8. The BOP of claim 7, wherein the tapered edge is configured to urge a seal element of the seal body into sealing engagement with an insert of the housing.

9. The BOP of claim 1, wherein:

the housing comprises an insert positioned within the vertical bore and between the shear body and the housing; and the insert comprises a material harder than a material of the housing;

wherein the shear body is configured to drive the object against the insert to facilitate shearing the object within the vertical bore.

10. The BOP of claim 1, wherein the shear body comprises:

an opening formed in a sidewall that defines the semi-cylindrical shape and that is configured to be aligned with the vertical bore of the housing while the shear body is in a first position within the vertical bore to enable fluid flow across the BOP; and a shear blade positioned along an edge of the opening and that is configured to shear the object as the shear blade rotates to a second position within the vertical bore.

11. The BOP of claim 1, further comprising an additional shear body to shear the object located within the vertical bore, wherein the shear body is rotatable about the cavity axis of the housing in a first direction and the additional shear body is rotatable about the cavity axis of the housing in a second direction opposite the first direction to facilitate shearing the object.

12. A blowout preventer ("BOP"), comprising:

a housing comprising a vertical bore extending through the housing and a cavity intersecting the vertical bore;

a shear body rotatable with respect to the vertical bore from a first position to a second position within the vertical bore to shear an object located within the vertical bore; and a seal body laterally movable within the cavity and into the vertical bore to form a seal about the vertical bore within the housing, wherein the seal body is configured to move relative to the shear body and into the vertical bore to form the seal while the shear body is in the second position within the vertical bore.

13. The BOP of claim 12, further comprising a seal body actuator operably coupled to the seal body to laterally move the seal body into the vertical bore of the housing, and a shear body actuator operably coupled to the shear body to rotate the shear body within the vertical bore of the housing.

14. The BOP of claim 12, wherein the vertical bore is defined about a vertical bore axis, the cavity is cylindrical about a cavity axis that is perpendicular to the vertical bore axis, and the shear body is a semi-cylindrical structure that is configured to move from the first position to the second position by rotating about the cavity axis of the cavity of the housing.

15. A method of shearing an object within a blowout preventer ("BOP"), comprising:

positioning the object within a vertical bore of the BOP;

rotating a shear body positioned at least partially within the vertical bore to shear the object; and subsequently laterally moving a seal body into the vertical bore to form a seal about the vertical bore within the housing while the shear body is positioned at least partially within the vertical bore.

16. The BOP of claim 12, wherein in the first position the shear body blocks the seal body from moving into the vertical bore to form the seal, and in the second position the shear body enables the seal body to move into the vertical bore to form the seal.

17. The BOP of claim 12, wherein the shear body engages the seal body within the vertical bore while the shear body is in the second position and while the seal body forms the seal.

18. The method of claim 15, wherein the vertical bore is defined about a vertical bore axis, the shear body is positioned at least partially in a cavity that is cylindrical about a cavity axis that is perpendicular to the vertical bore axis, and rotating the shear body comprises rotating the shear body about the cavity axis.

* * * * *